United States Patent [19]

Harper, Jr.

[11] 3,976,132

[45] Aug. 24, 1976

[54] TUBING SPREADER MECHANISM

[75] Inventor: Roland George Harper, Jr., Lafayette, La.

[73] Assignee: Lamb Industries, Inc., Lafayette, La.

[22] Filed: May 21, 1975

[21] Appl. No.: 579,415

[52] U.S. Cl. ..... 166/85; 24/263 DM; 166/94

[51] Int. Cl.[2] ..... E21B 33/06

[58] Field of Search ..... 166/85, 94; 24/263 DM, 24/263 CA, 263 DA, 263 DM

[56] References Cited

UNITED STATES PATENTS

| | | | |
|---|---|---|---|
| 2,591,859 | 4/1952 | Otis | 24/263 CA |
| 3,154,146 | 10/1964 | Brown | 24/263 DM |
| 3,554,278 | 12/1970 | Reistle | 166/85 |

*Primary Examiner*—James A. Leppink
*Attorney, Agent, or Firm*—Fulbright & Jaworski

[57] ABSTRACT

A tubing spreader mechanism for positioning vertically disposed tubing strings in a multiple completion well to maintain them in a desired center-to-center alignment. The tubing spreader has a support member designed to mount on top of a multi-string spider. An adjustable roller assembly is mounted to the support member and engages the tubing strings placing them in the desired center-to-center alignment with the spider. The tubing spreader mechanism can be used with tubing strings of identical diameters or different diameters.

2 Claims, 4 Drawing Figures

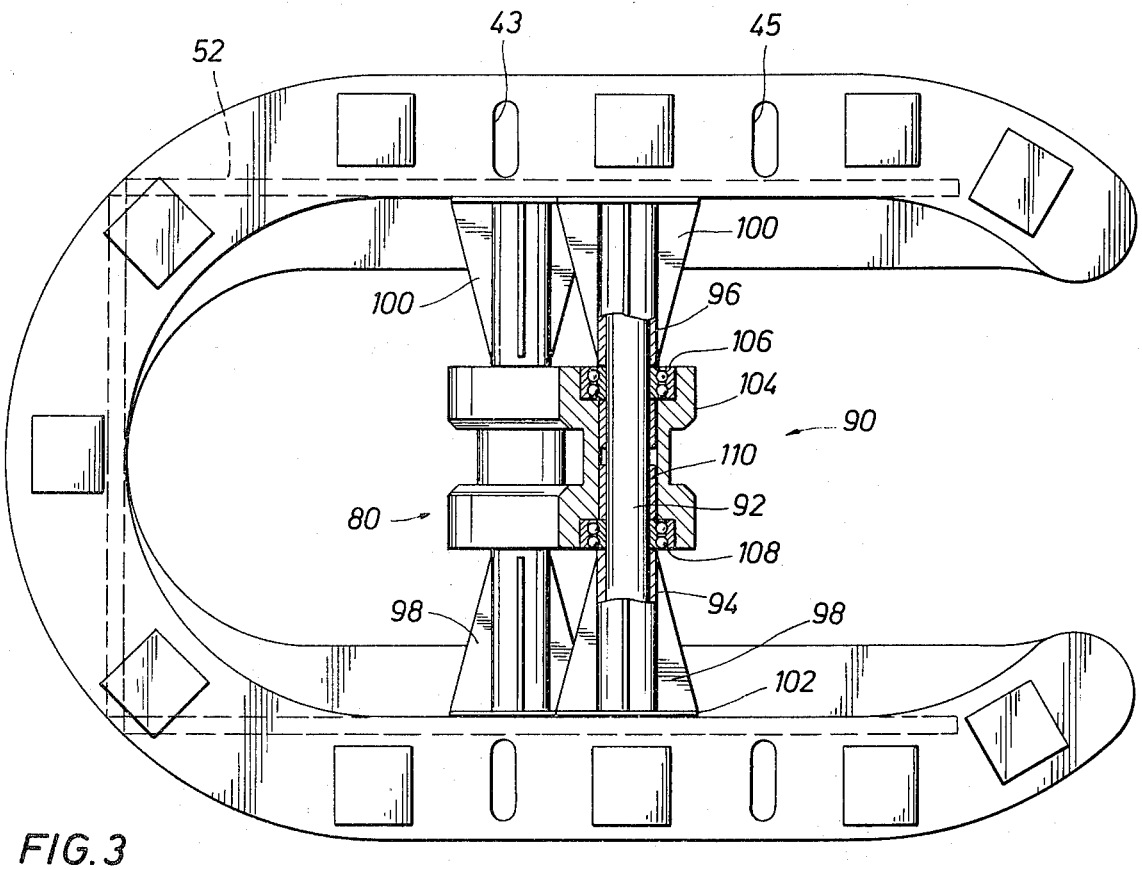
FIG. 3
FIG. 4
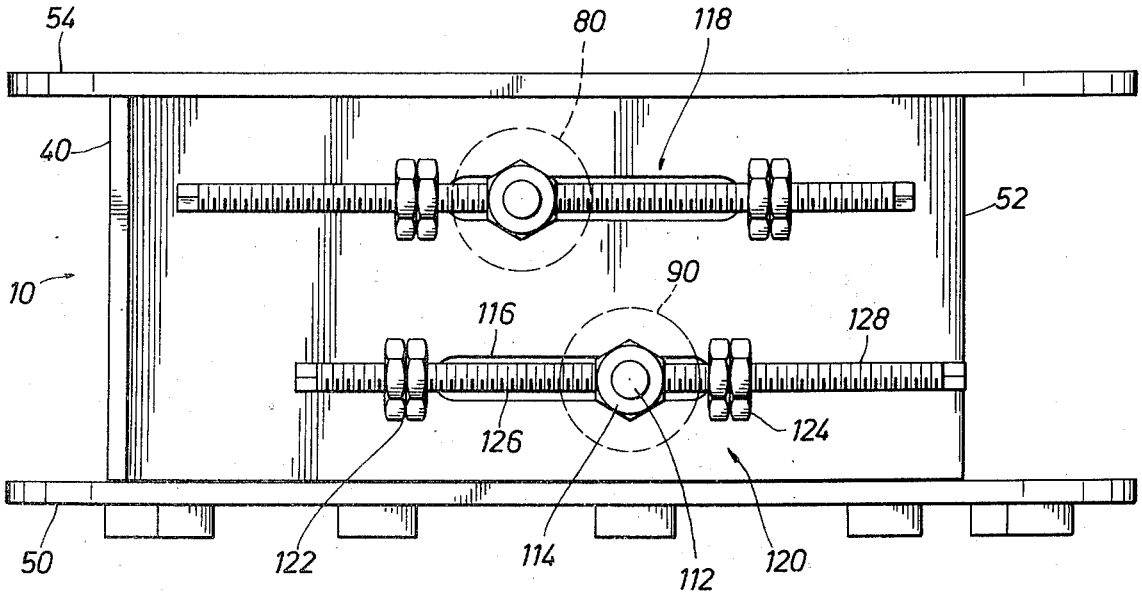

TUBING SPREADER MECHANISM

BACKGROUND OF THE INVENTION

This invention relates to oil field tools for use in multiple completion wells, and more particularly, the invention relates to mechanisms for use in conjunction with multiple tubing spiders and slips.

Since the beginning of oil well drilling, tubing of some type has been inserted in the bore of a well to enable it to be produced under control. Some means has always been required for holding the tubing to prevent it moving down the bore further than desired when inserting or "running the string of pipe", piece by piece, or when it was necessary to hold the string of pipe in a given position, Currently in use is a tool known as a spider. A spider is positioned atop a rotary table and aligned with the well bore. Spiders include clamping jaws known as slips. Tubing spiders have been greatly improved over the years, and the spiders of today are power actuated and remotely controlled by compressed air or hydraulically.

Many, if not most, recently drilled oil wells are designed for production from two or more production zones at different depths within a single well bore. Wells having two or more strings for the purpose of producing petroleum products such as oil, gas, distillate, etc., are referred to generally as multiple completion wells, or in the case of two production zones, dual completions. Most wells are dual completion wells having a pair of tubing strings extending from a well head downwardly to the different production zones. The two tubing strings may be of the same diameter, or they may be of different diameters.

As with single completion wells, dual completion wells require some type of holding mechanism for supporting the pipe strings during the running operation. To perform this function, spiders and slips were modified to accommodate two pipe strings rather than one. Spiders adapted for use with dual completion wells contain two slip assemblies, one for each tubing string. For the slip assemblies to properly engage and hold the tubing strings, the tubing strings themselves must be in proper location.

Difficulty has been experienced in the running of pipe strings in multiple completion wells having a diameter which is such that the centers of the tubing strings move off center from the slip centerlines of the spider being used. The tubing strings have been observed to move off their respective centerlines toward the outside of the well bore or toward the center of the well bore, i.e., bow out or bow in. To put the tubing strings into proper alignment so that the slip assemblies can engage the tubing strings, workmen have had to use crowbars to force the tubing into alignment. Obviously, this greatly slows down and complicates the running of tubing strings into a well bore.

It is apparent that a durable, reliable and simple mechanism for maintaining the centerline alignment of the tubing strings in a multiple completion well is highly desirable to permit the rapid and efficient running of pipe strings into a well bore.

SUMMARY OF THE INVENTION

There is accordingly provided by this invention a novel tubing spreader mechanism for maintaining the proper center-to-center alignment of tubing strings in multiple completion wells.

There is provided a tubing spreader mechanism which is adjustable to permit its use with tubing strings of different diameters.

There is further provided by the instant invention a tubing spreader mechanism for maintaining tubing center distance which is suitable for use with conventional multiple completion spiders.

There is yet further provided a tubing spreader mechanism which allows the tubing strings to pass into the well bore without any drag, scraping or hangups.

Tubing spreader mechanisms in accordance with the present invention are fully adjustable, providing proper tubing string center distance for multiple completion wells using tubing strings of identical diameters or different diameters. The tubing spreader has a support member designed to mount on top of a multi-spring spider. An adjustable roller assembly having first and second guide rollers mounts to the support member. A roller assembly adjustment mechanism positions the guide rollers to engage the vertical tubing strings placing them in a desired center-to-center alignment.

Other features and advantages of the present invention will become more apparent from the description that follows, when considered in conjunction with the drawings.

BRIEF DESCRIPTION OF THE DRAWINGS

FIG. 3 is a bottom view of the tubing spreader showing the roller assemblies in detail.

FIG. 4 is a side view of the tubing spreader showing the roller assembly adjustment mechanisms in detail.

DESCRIPTION OF THE PREFERRED EMBODIMENT

Figure 1:
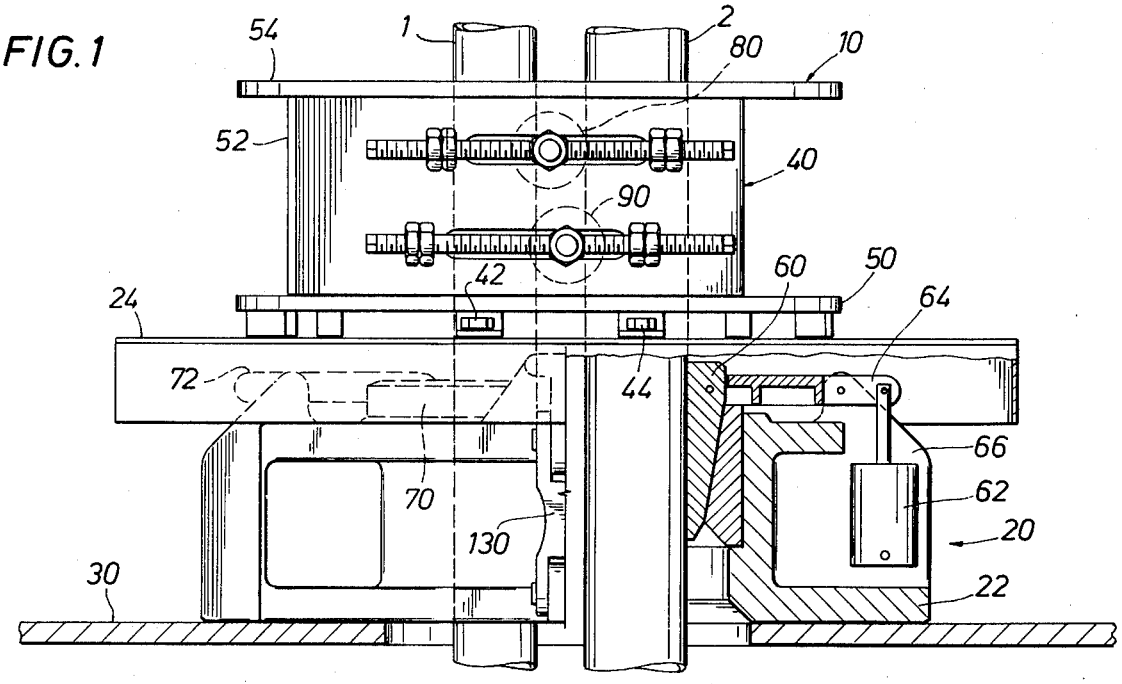
FIG. 1 is a side view with partial cut-away of the present invention mounted on a dual string spider.

Referring now to the drawings wherein like reference numerals designate identical or corresponding parts throughout the several views, more particularly to FIG. 1 thereof, there is illustrated one embodiment of a tubing spreader in accordance with the present invention. The tubing spreader 10 is shown mounted on top of a spider 20, a conventional tool well known to those skilled in the oil tool art. Spider 20 is, of course, above a rotary table 30. This particular embodiment of the invention is for use with a dual completion well; therefore, there are two tubing strings 1 and 2.

The tubing strings 1 and 2 are being gripped by slips 60 and 70. The slips hold the tubing strings to prevent them from falling to the bottom of the well. Slip 60 is a hydraulically actuated slip controlled by a hydraulic or air cylinder 62 and crank arm 64. The crank arm 64 and hydraulic or air cylinder 62 are both mounted to gate block 66 which mounts to spider bowl 22. Slip 70 is connected in a similar manner by crank arm 72. For the slips 60 and 70 to move into the gripping position shown, the tubing strings 1 and 2 must be properly aligned, that is, the tubing strings must be in center-to-center alignment to match the center-to-center distance of the dual string spider 20. This distance is typically 6 ½ inches. If the tubing strings tend to assume a different center-to-center distance, slips 60 and 70 cannot by actuated to enclose and grip the tubing strings.

Tubing spreader 10 of FIG. 1 has a support member 40 which is secured to spider 20 by bolts 42, 44, 46 and 48 (not shown) which extend through the spider guard 24. Spider guard 24 provides a shield for the hydraulic components and mechanical linkage of the spider. Spider guard 24 also affords a walking platform around the equipment. Support member 40 has a lower plate 50 of uniform thickness which is designed to mount on spider 20. A vertical member 52 is welded to lower plate 50 and extends vertically upward. Vertical member 52 may be constructed of plate stock. In the preferred embodiments shown, vertical member 52 forms a box like structure. An upper plate 54 is attached to vertical member 52 placing lower plate 50 and upper plate 54 in a spaced apart relation.

Figure 2:
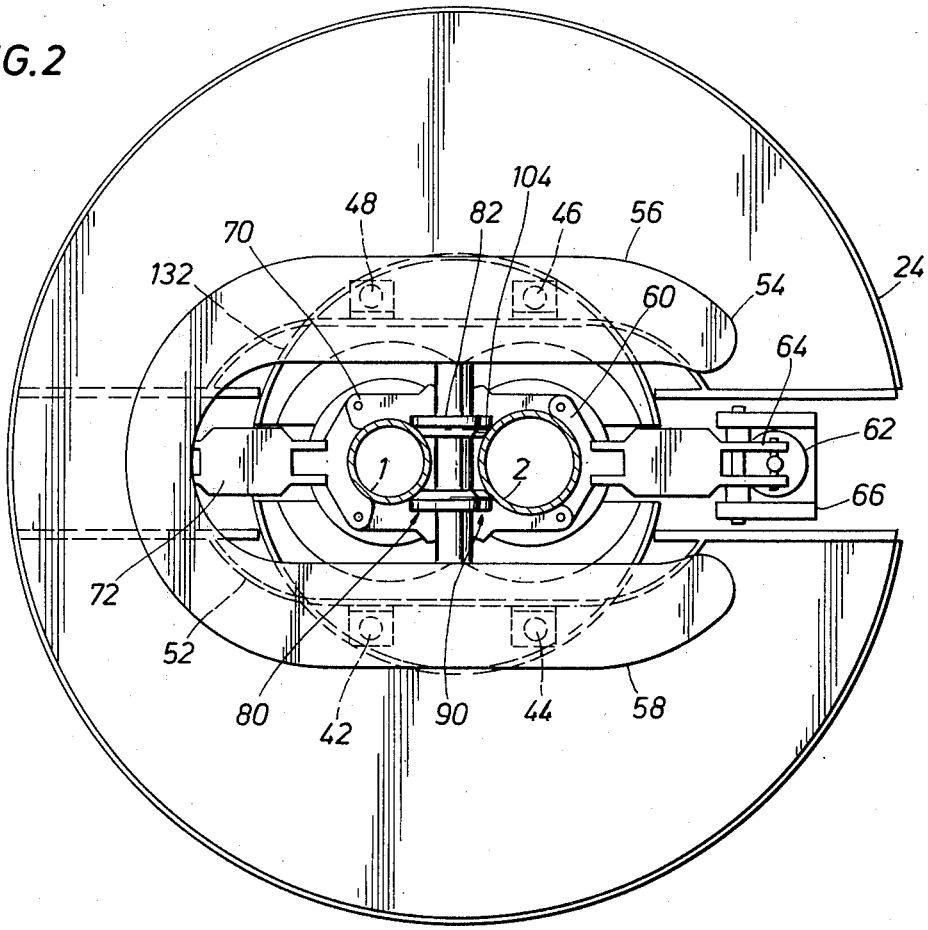
FIG. 2 is a top view of the apparatus of FIG. 1 showing the slips of the dual string spider in place around their respective tubing string.

Referring now to FIG. 2, there is shown a plan view of the tubing spreader 10 illustrated in FIG. 1. Also in view are the various components of spider 20 referred to previously in regard to FIG. 1. In this figure, both lower plate 50 and upper plate 54 are observed to be U-shaped. The tubing strings 1 and 2 extend through the space between the opposing plate arms 56 and 58 which form the U-shape. Extending transversely to the opposing plate arms 56 and 58 are adjustable roller assemblies 80 and 90. Adjustable roller assembly 80 includes a rotary roller guide 82 in contact with tubing string 1. Roller assembly 90 includes a similar roller guide 104 which is in contact with tubing string 2. Rotary roller guides 82 and 104 maintain tubing strings 1 and 2 on proper centers to permit slips 60 and 70 to be actuated for engagement. Vertical member 52 is shown in phantom in this view to be a three sided rectangularly shaped structure.

FIG. 3 is a bottom view of tubing spreader 10 showing lower plate 50 and roller assemblies 80 and 90. Roller assembly 90 is shown in detail in a sectioned view. Roller assembly 90 is carried on a roller shaft 92. The ends of roller shaft 92 are supported in slots 116 and 117 (not shown) which are in support member 40. Shaft housings 94 and 96 which are reinforced with support webbing 98 and 100 serve as spacers for the guide roller 104. Both shaft housing 94 and support webbing 98 attach to flange plate 102. Guide roller 104 includes roller bearings 106 and 108. A spacer 110 extends between roller bearings 106 and 108 serving as reinforcement for guide roller 104. Rotational movement of guide roller 104 is about roller shaft 92 as provided by roller bearings 106 and 108.

Roller assemblies 80 and 90 extend between opposing sides of support member 40 with dimensions such that a close fit is provided. In this view, vertical member 52 is shown in phantom. Also, mounting slots 43, 45, 47 and 49 in lower plate 50 are shown.

Turning now to FIG. 4, there is shown a side view of tubing spreader 10 in which roller adjustment mechanisms 118, 120 are shown in detail. Adjustment mechanism 118 and adjustment mechanism 120 are identical, therefore, only roller adjustment mechanism 120 will be described in detail. Roller shaft 92 has a threaded end 112 which extends through a slot 116 in the side of support member 40. A jam nut 114 is used to secure the position of roller assembly 90 when it is placed in the desired position. A pair of threaded nuts 122 and a second pair 124 are welded to the outside surface of support member 40. A threaded shaft 126 is carried in threaded nuts 122. Another threaded shaft 128 is carried in threaded nuts 124. Both threaded shaft 126 and threaded shaft 128 engage a spacer (not shown). An identical arrangement of threaded shafts is carried on the other side of support member 40. To adjust the position of roller assembly 90, jam nut 114 is loosened permitting roller assembly to slide horizontally to the desired location within slot 116. The threaded shafts 126 and 128 are then turned until they engage the spacer to fix the position of roller assembly 90 within slot 116. Jam nut 114 is then tightened pulling flange plate 102 (FIG. 3) into contact with support member 40.

The foregoing description of the invention has been directed to a particular preferred embodiment. It will be apparent, however, to those skilled in this art that many modifications and changes may be made without departing from the scope and spirit of the invention. It is the applicant's intention in the following claims to cover all such equivalent modifications and variations as fall within the true spirit and scope of the invention.

What is claimed is:

1. A tubing spreader mechanism for use with a dual string spider to maintain proper alignment and center-to-center distance between vertically disposed tubing strings entering a well bore, comprising:

a support member for mounting on top of a dual string spider;

first and second guide rollers rotatable about and having respective shafts independently and adjustably movable in a horizontal direction within slots formed in said support member; and threaded adjustment rods carried in threaded supports attached to said support member for positioning said guide rollers in contact with the tubing strings placing them in desired center-to-center alignment with the spiders.

2. The apparatus of claim 1, further comprising:

locking means for securing said first and second guide rollers in a fixed position within said support member.

* * * * *

UNITED STATES PATENT OFFICE

CERTIFICATE OF CORRECTION

PATENT NO. : 3,976,132

DATED : August 24, 1976

INVENTOR(S) : Roland George Harper, Jr.

It is certified that error appears in the above-identified patent and that said Letters Patent are hereby corrected as shown below:

Column 2, line 55, after "hydraulically" insert --or air--

Signed and Sealed this

Second Day of November 1976

[SEAL]

*Attest:*

RUTH C. MASON
*Attesting Officer*

C. MARSHALL DANN
*Commissioner of Patents and Trademarks*